United States Patent [19]

Troyan et al.

[11] Patent Number: 4,580,492

[45] Date of Patent: Apr. 8, 1986

[54] PRODUCT CODE WHEEL ASSEMBLY

[75] Inventors: Peter B. Troyan, Twinsburg; Kenneth G. Koltas, Elyria; Daniel P. Golkowski, Newburgh Heights, all of Ohio

[73] Assignee: The Stouffer Corporation, Solon, Ohio

[21] Appl. No.: 709,324

[22] Filed: Mar. 7, 1985

[51] Int. Cl.[4] ..... B41F 17/00

[52] U.S. Cl. ..... 101/6; 101/28; 101/36; 101/377

[58] Field of Search ..... 101/5–7, 101/35–37, 328–331, 375–377, 28, 29, 31, 23

[56] References Cited

U.S. PATENT DOCUMENTS

| | | | |
|---|---|---|---|
| 1,236,828 | 8/1917 | Erickson | 101/28 |
| 1,471,443 | 10/1923 | Bracht | 101/28 |
| 1,514,109 | 11/1924 | Stenstrom | 101/375 |
| 1,538,079 | 5/1925 | Albertoli | 101/35 |
| 2,186,788 | 1/1940 | Olson | 101/37 X |
| 2,358,674 | 9/1944 | Weber | 101/377 |
| 2,585,410 | 2/1952 | Schott | 101/5 X |
| 3,064,566 | 11/1962 | McVicker | 101/5 X |
| 3,083,636 | 4/1963 | Carkhuff | 101/37 |
| 3,093,070 | 6/1963 | Beaver | 101/376 |
| 3,247,785 | 4/1966 | Sholtz | 101/23 |
| 3,921,524 | 11/1975 | Ritchie | 101/329 |

*Primary Examiner*—Clifford D. Crowder
*Attorney, Agent, or Firm*—Body, Vickers & Daniels

[57] ABSTRACT

A code wheel for imprinting legends on packages traveling along a conveyor line has a U-shaped slot therein through which the code wheel is coaxially positioned on a drive sleeve rotatable with the line and drive pins engage the sleeve to index the code wheel thereon as resiliently held thereagainst by a releasable collar. Print type carried on the outer surface of the code wheel are independently secured by individual spring detents. A roller having an outer resilient cover is pivotally supported on the conveyor line and spring biased toward the code wheel for establishing the printing pressure on the packages.

12 Claims, 7 Drawing Figures

PRODUCT CODE WHEEL ASSEMBLY

BACKGROUND OF THE INVENTION

The present invention relates to coding devices and, in particular, a code wheel for imprinting product code information on containers traveling along a packaging conveyor line.

The present invention finds utility with respect to cartons, packages and like containers which must bear legendary information with respect to the manufacturing process. This is particularly true for the food processing industry and the present invention will be described with specific reference thereto although it will be appreciated that the product coder is widely applicable to situations where the coded information is required for each item being packaged. By coding certain categories of manufacturing and product information on the container, each item becomes a referenced and traceable product. For instance, the code may contain data regarding the date and time of manufacture, the product location thereof, as well as product content information. In the event of problems associated with the product, the code will assist in identifying the underlying causes by enabling cross-reference to the process parameters at the time and location of manufacture. Should a recall of products be required, the consumer or merchant will be able to quickly determine whether their goods are involved by examining the product code imprinted on the container. The more information the code contains, the easier it becomes to obtain accurate referencing of the product and its manufacture.

Generally, the product code is printed on the carton contemporaneously with the final packaging of the product. As the filled carton moves along the packaging conveyor line, a suitable portion of the carton, such as the end flap, passes under a rotating code wheel. The code wheel contains a circumferential series of type having raised characters corresponding to the code. As the flap of the carton passes between the code wheel and a back-up roller, the product code is impressed or debossed on the flap. It is of prime importance that the product code be regularly updated with manufacturing time designations. While in some instances a date may be sufficient, generally it is preferred to update the product code on an hourly basis. For each such update in the product code, the production line must be stopped and the code wheel removed or replaced with a code wheel bearing the current information. During this changeover, the entire production line is stopped thereby halting both upstream processing and downstream packaging operations. As production rates oftentimes exceed 200 units per minute, the changeover can result in significant lost production. Inasmuch as these code wheels must provide uniform debossing and printing location on the flap, the wheels must be mounted for synchronized rotation with the conveyor line. Generally, this is provided by a line driven rotating shaft on which the code wheel is rotatably supported. The code wheel is coupled to the shaft by suitable fasteners, such as set-screws or the like, and indexed thereon by keys or flats. The removal and replacment of the code wheels requires operator access to such fasteners. When the line is stopped however, the fastener may not be accessible thereby requiring momentary starting and stopping of the line until the fastener access is obtained. This increases the changeover time and requires high level operator dexterity. The dexterity and orientation requirements result in substantial time being required for the changeover of such devices. The debossing pressure for the product code is provided by hardened back-up wheel which is spring biased against the outer surface of the code wheel with the carton flap passing therebetween. At the high production speeds, the impacting of the code wheel type against the back-up wheel causes a peening of the type characters. Over a period of time, the type clarity is lost and the type must be replaced. However, the new type also presents problems. If significantly higher than the remaining characters, the new character may penetrate the flap and result in a loss of carton integrity after sealing. At the aforementioned high rates of production, the type must be securely retained against centrifugal force while being removable for product code changes. This is typically been provided by the use of a elastomeric o-ring, which is retained in a circumferential groove and engages a groove on the side face of the type. However, the o-ring is subject to wear, particularly at the location of highest change frequency. Due to excessive wear, the type is prone to ejection from the code wheel with the consequent loss of production time and loss of improperly coded product.

BRIEF SUMMARY OF THE INVENTION

The present invention overcomes the above-mentioned problems associated with prior art code wheels by providing a product coder for imprinting codes on cartons which are removed and installed by easily executed, self-aligning movement regardless of wheel orientation and which securely holds readily removable print and prints with greater clarity over lengthened periods of time. These features are achieved by a cylindrical code wheel which has a U-shaped axially extending and radially opening slot. The slot has a cylindrical base surface which engages a sleeve secured to the conveyor line indexing shaft. When the code wheel is inserted through the slot onto the sleeve, it is coaxially aligned with the shaft. The code wheel further includes axially projecting drive pins which are disposed on one axial end face. The drive pins register with complementary formed holes on a flange of the sleeve. By rotating the wheel about the base to the indexed position and thereafter axially shifting the wheel into abutment with the sleeve, the code wheel is circumferentially and axially located in the proper position. These positional movements can be accomplished independent of shaft orientation and without requiring operator line of sight access. The code wheel is retained in the indexed position by means of a spring biased collar which is compressed to permit insertion and release of the code wheel and which upon release resiliently biases the code wheel against the flange to lock the code wheel to the sleeve.

The code wheel further includes a plurality of radial slots of rectangular cross-section. Type having the appropriate code characters are slidably received in the slots. Individual spring biased detents carried on the code wheel engage detent grooves in the type to securely hold the type in place while readily accommodating removal and insertion thereof. The detents are also effective to compensate for type wear without loss of retention force. The aforementioned peening of the type face is overcome by a spring biased resilient roller. The roller establishes a uniform but yielding pressure at the type face notwithstanding differential character type heights. The code wheel assembly as above described may be removed and replaced with a code wheel of a current code with great rapidity in comparison with the prior devices requiring set screws and like fasteners typically in less than one-half minute. This contrasts with about one to two minutes required for skilled operators to replace prior coding devices. At the packaging rates as described above, the time saving substantially increases production rate and the printing uniformity reduces the number of improperly coded containers.

BRIEF DESCRIPTION OF THE DRAWINGS

The above objects and other benefits of the present invention will be apparent to those skilled in the art upon reading the following detailed description of a preferred embodiment taken in conjunction with the accompanying drawings in which.

DETAILED DESCRIPTION OF THE INVENTION

Figure 2:
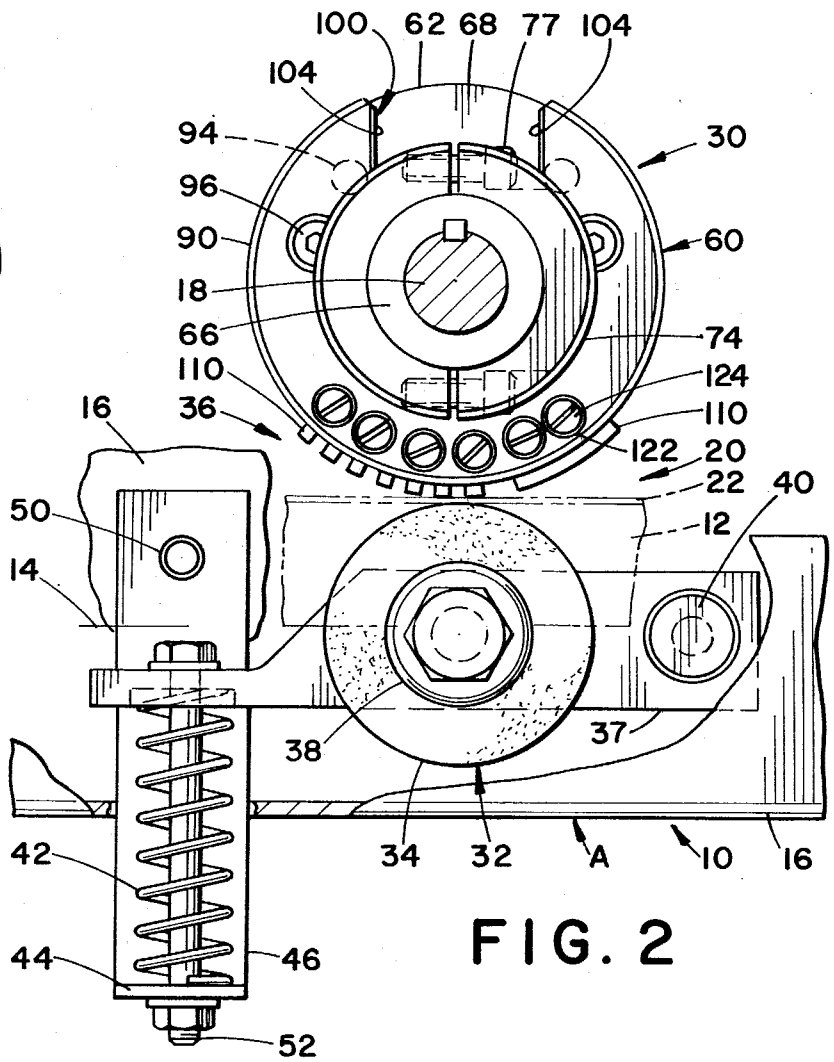
FIG. 2 is an end view of the product code wheel assembly shown in FIG. 1.
Figure 1:
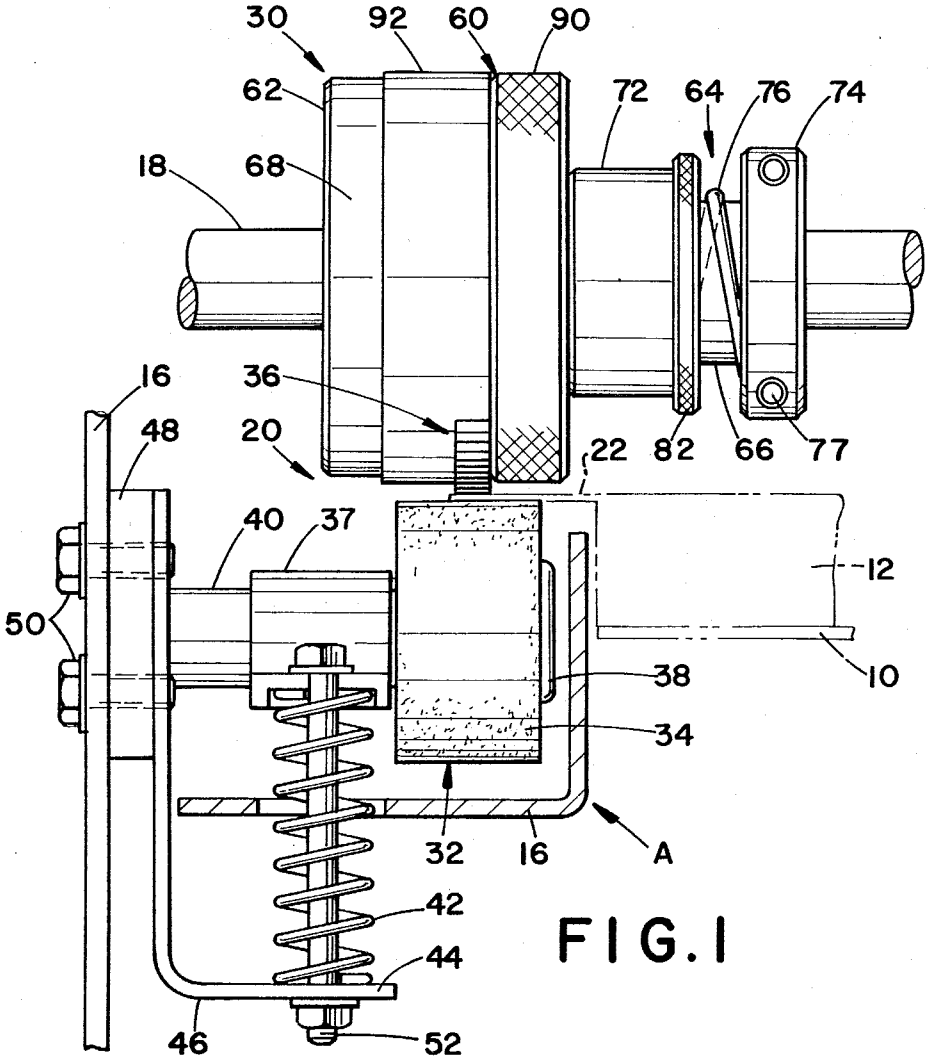
FIG. 1 is a side elevational view of a product code wheel assembly made in accordance with the present invention showing the type in the printing position for debossing a product code on the end flap of a carton traveling along a conveyor line.

Referring now to the drawings wherein the showings are for the purposes of illustrating the preferred embodiment of the invention only and not for purposes of limiting same, FIGS. 1 and 2 show a product conveyor line A having a conveyor belt 10 for moving product cartons 12 along a horizontal conveyor path 14. The conveyor line A including the belt 10 and associated conveyor frame 16, partially illustrated, may be of any commercially available type and does not constitute a part of the present invention. Conventionally operatively associated with the conveyor system A, is a transversely projecting shaft 18 which is rotated in synchronization with the movement of the conveyor belt 10 by a drive mechanism, not shown. A product code assembly 20, as hereinafter described in detail, debosses or imprints a product code on an end flap 22 of the carton 12 as the carton 12 moves past a product coding station.

The product code assembly 20 comprises a code wheel assembly 30 rotatably mounted on the shaft 18 and a back-up wheel assembly 32 mounted on the conveyor frame 16. The back-up wheel assembly 32 is located adjacent to the side of the conveyor belt 10 such that a back-up roller 34 thereon supports the lower surface of an end flap 22 in a substantially horizontal printing position. The shaft 18 and the code wheel assembly 30 are transversely located with respect to the conveyor path 16 and sized and located thereabove such that a type array 36 carried by the code wheel assembly 30 engages the upper surface of the end flap 22 with sufficient printing pressure to deboss a product code legend thereon. The product coding station may be located at various locations along the conveyor line, but preferably at a point after the carton 14 has been filled with product and before the final sealing of the carton 14. The product code imprinted by the type array 36 will thus constitute a product code containing data referencing the manufacture of the completed product.

The back-up wheel assembly 32 comprises the roller 34 which is rotatably mounted on a pivoting bracket 37 by means of a bearing assembly 38. One end of the bracket 37 is pivotally connected to the frame 16 by a pin 40 which is welded to the frame 16. The outer end of the bracket 37 is horizontally supported by a compression spring 42 which is carried by the base leg 44 of an L-shaped mounting bracket 46 which is secured to the frame 16 by means of a spacer plate 48 and fasteners 50. The upper end of the spring 42 is retained within a downwardly opening counterbore on the lower surface of the bracket 36. A nut and bolt assembly 52 extends axially through the spring and vertically aligned holes in the brackets 36 and 46 by adjustment of the length of the assembly 52, the printing pressure of the wheel 34 against the type array 36 can be controlled. The spring 42 also permits resilient deflection of the back-up roller 34 and bracket 36 about the pin 40 to maintain continuous contact between the code wheel assembly 30, including the type array 36.

The code wheel assembly 30 comprises a two-piece product code wheel 60 drivingly connected to a drive hub 62 carried by the shaft 18 and releasably held thereagainst by a spring collar assembly 64.

Figure 3:
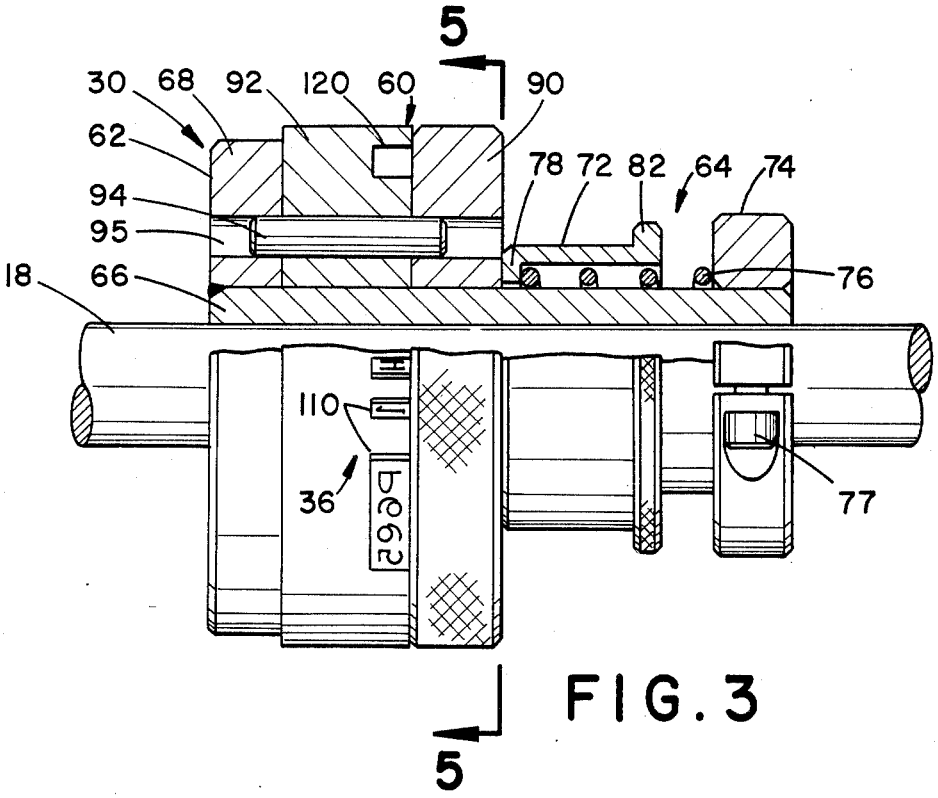
FIG. 3 is a partially sectioned side elevational view of the code wheel in the operative position.
Figure 4:
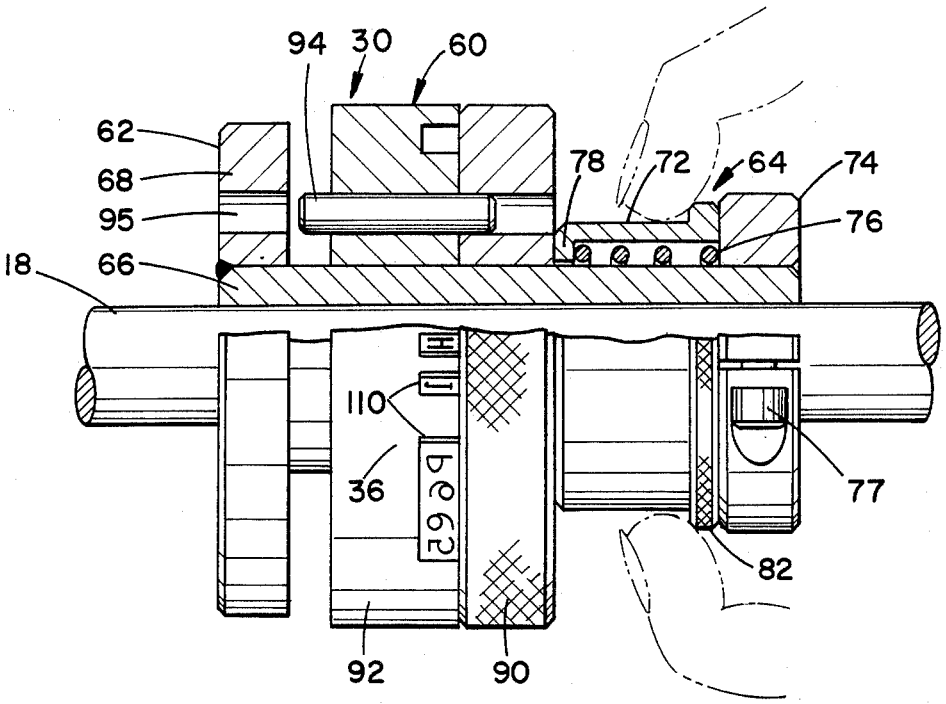
FIG. 4 is a view similar to FIG. 3 showing the code wheel in the released position.
Figure 5:
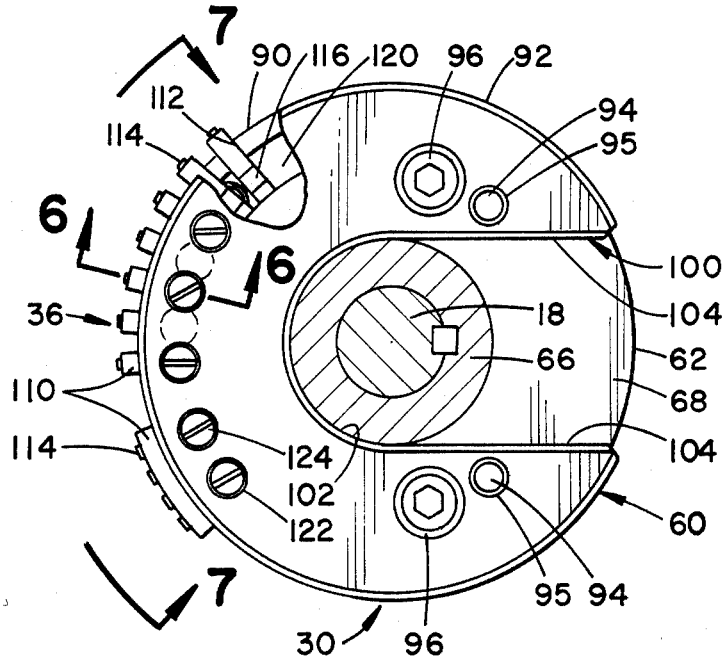
FIG. 5 is a view taken along line 5—5 of FIG. 3 showing in fragmentary section the retention of the type in the code wheel.

Referring to FIGS. 3 and 4, the drive hub 62 comprises a cylindrical sleeve 66 having an annular axial flange 68 welded at one end thereof. As shown in FIG. 2, the shaft 18 and the sleeve 66 are provided with oppositely facing axially extending keyways which retain a square key, as shown in FIGS. 2 and 5 for locking the drive hub 62 to the shaft 18. The drive hub 62 may additionally be provided with suitable fasteners such as set screws for further increasing the coupling with the shaft 18.

The spring collar assembly 64 is retained at an inboard end of the sleeve 66 and comprises a release collar 72, a stop ring 74 and a compression spring 76. The stop ring 74, as shown in FIG. 2, is a split circular ring having the individual halves threadably connected by means of set screws 77 for clamping the stop ring 74 to the sleeve 66.

Referring to FIGS. 3 and 4, the release collar 72 is generally cylindrical and has a radially inwardly turned annular flange 78 which is slidably received over the outer surface of the sleeve 66. A radially outward annular flange 82 is formed at the other end of the collar 72 and may be suitably knurled to facilitate manual gripping thereof. The compression spring 76 is received over the outer surface of the sleeve 66 and has one end which engages the inner surface of the flange 78 of the release collar 72 and the other end which engages the stop ring 74. The collar 72 may be manually axially shifted against the biasing of the spring 76 to shift the collar 72 between the released position shown in FIG. 3 and the retracted position shown in FIG. 4. The position of the stop ring 74 may be axially adjusted on the sleeve 66 to vary the compression of the spring 76 but to still provide for the insertion and removal of the code wheel 60 as hereinafter described.

Referring to FIGS. 3 through 5, the code wheel 60 comprises a cap 90 and a type holder 92 which are aligned by two drive pins 94 and clamped together by two set screws 96. The code wheel 60 is cylindrical and has a U-shaped axial slot 100 formed therein as more clearly shown in FIG. 5. The slot 100 is defined by semi-circular base 102 and parallel side walls 104, extending from the base to the periphery of the code wheel 60. The base of the code wheel 60 has a close sliding fit with the outer surface of the sleeve 66 to coaxially align the code wheel thereon. The width of the radial opening defined by the slot 100 is slightly greater than the diameter of the sleeve. The U-shaped slot in the cap 90 may be the same as, but is preferably slightly wider than the slot in the type holder 92. By virtue of the dimensions of the slot 100, the code wheel 60 may be positioned on the shaft 18 by radial insertion until the outer surface of the sleeve 66 engages the base 102 of the slot 100. At this point, the code wheel 60 will be coaxially aligned with the shaft 18. As the code wheel 60 is axially translated along the sleeve 60 or rotated thereabout, the coaxial alignment is maintained.

The drive pins 94 are press fitted through holes 95 in the type holder 92 with free ends axially projecting outwardly on either side thereof. One free end is slidably received within a through hole in the cap. The other free end is slidably received within a through hole in the flange 62. The sliding fits of the drive pins circumferentially and radially orient the cap 90 with the type holder 92 and circumferentially indexes the code wheel 60 with respect to the shaft 18. It also provides the driving connection between the rotating shaft 18 and the code wheel 60 through the drive hub 30.

For assembly, the collar 72 is retracted as shown in FIG. 4, and the code wheel 60 is axially inserted onto the shaft 18 until the base 102 of the slot 100 engages the outer surface of the sleeve 66 thereby providing the radial alignment. While maintaining the drive alignment, the code wheel 60 is rotated until the drive pins 94 are aligned with the holes in the flange 68. The code wheel 60 is then axially shifted toward the flange 68 until the facing surfaces of the type holder 92 and the flange 68 abut. The spring collar 72 is released and the spring 76 compressively biases the code wheel 60 against the flange 68 to maintain the indexed relationship with the shaft 18. For removal of the code wheel 60, the aforementioned procedures are reversed. As shown in FIG. 4. the collar 72 is retracted and the code wheel 60 axially shifted until the pins 94 exit the flange holes. The code wheel 60 is rotated about the base 102 until the slot is aligned with the permissible withdrawal path and radially withdrawn from the shaft without interference from surrounding conveyor structure. The aforementioned insertion and removal may be provided by operator feel alone in view of the self guided alignment surfaces provided by the assembly.

Figure 7:
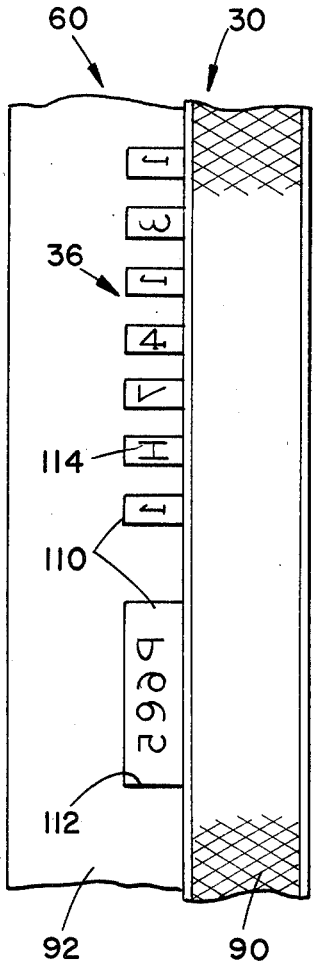
Figure 6:
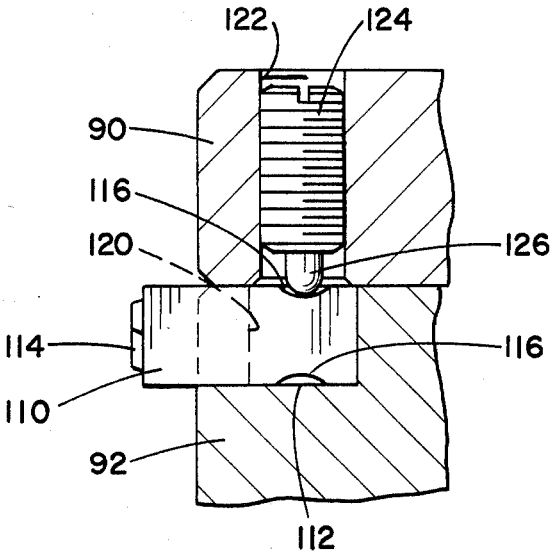
FIG. 6 is an enlarged sectional view taken along line 6—6 of FIG. 5 showing the detented retention of the type, and, FIG. 7 is an enlarged developed view taken along line 7—7 of FIG. 5 illustrating the arrangement of the product code characters on the code wheel face.

The type array 36 is comprised of a circumferential series of individual type 110 retained in radial slots 112 formed in the type head 92. Referring particularly to FIGS. 5 through 7, the type 110 have rectangular cross-sections and are formed with alpha-numerical raised characters 114 on the outer face thereof. Transverse recesses 116 are formed in opposed lateral faces thereof. The type may include a single character or may comprise a series of characters. The single character type are preferably rectangular solids while the multi-character type may be sector shaped with radially converging side walls. The type head 92 has a circumferential channel 120 formed in the axial face abutting the cap 90. The inner diameter of the channel forms the abuttment surface for the type 110 and has a diameter in relation to the height of the type that establishes a predetermined projection of the type beyond the outer circumferential surface of the code wheel. A plurality of constant width radial slots are formed outwardly of the channel and in assembly provide for a sliding fit of the single character type into seated relationship. The sector type may have parallel side walls or depending on the extent of the sector, may have inwardly converging walls with the slots being similarly formed. A plurality of threaded holes 122 are formed in the head 92 and the cap 90 and alternatingly register with the type slots 110. Threaded fasteners 124, having captive spring-biased tips 126 are threadably inserted in the holes 122 with the tips compressively engaging the surface of the recesses 116 to thereby releasably retain the type 110. Two such fasteners may be provided for the sector type. By alternating the location of the holes 122 between the cap 90 and the head 92, even narrow width type can be individually retained. The type may be removed and installed by using a suitable tool such as pliers to grasp projecting portions of the type and sliding that type past the detenting of the fasteners 124.

Referring specifically to FIG. 7, the type array 36, for illustration purposes, comprises a series of seven individual character type and one sector multi-character type. The type characters are mirror images such that the debossing on the carton flap will bear conventional orientation. Depending on the rotation of the code wheel, the circumferential series will be appropriately arranged. For illustration purposes, the code array reads as "1 3 1 4 7 H 1 P695." The debossment of this character array establishes the product code or legend designating certain aspects relative to the manufacturing operation and the product. Rather than straight numerical, alphabetical characters may be used as required to increase the information content for a given number of type characters. For instance, the first number may designate plant site and the second number the production line at that site. The third through fifth characters may designate the day of manufacture, the sixth character an alphabetical designation for hour of manufacture and the seventh character a designation of the year of manufacture. The sector legend may contain code information relative to the product itself or other manufacturer information which is separate from the product code itself.

Referring to FIGS. 1–2, in operation, the shaft 18 will rotate in synchronization with the speed of the conveyor belt 10. The outer diameter at the type 110 is selected to match the peripheral speed of the belt 10 such that the carton flap 22 will be imprinted by the type array 36 with a rolling, non-slipping, printing action. More particularly, the carton 12 will be shuttled along the conveyor belt and spaced from adjacent containers by means of projecting lugs or the like, not shown. The lugs will be synchronized with respect to the rotation of the shaft such that the printing on the flap 22 will commence in a select longitudinal area thereof. As the carton approaches the printing station, the lead edge of the flap will roll over the outer surface of the back-up wheel 34. Preferably the back-up wheel will be spaced from the outer surface of the head by means of the fastener assembly 52. As the lead character of the type array engages the top surface of the flap 22, the back-up roller 34 will establish sufficient pressure to emboss the character in the surface thereof. The other characters will be sequentially debossed thereon. The debossing will sequentially take place as each container flap is presented at the coding station. The resilient material in the back-up roller provides a resilient printing surface for the type characters and accommodates variations in the projecting type height. Accordingly, the uniform pressure will be exerted at the printing interface notwithstanding the height variations as may be caused by the difference in the wear rate of the individual characters. This also avoids any peening action which is likely to occur without a deflectable and resilient roller.

At time of code revision, which typically will take place on an hourly basis, the conveyor line A is stopped. The code wheel 60 may come to rest at any random circumferential orientation. Inasmuch as no fasteners are involved in the subject assembly, the rest position is not critical to the removal and replacement of the code wheel 60. For removal as described above, the operator merely retracts the collar 72, grasps the cap and axially slides the code wheel 60 from engagement with the flange 66. This releases the drive pins from the holes and permits the code wheel to be rotated about the sleeve 66 until the slot 100 is aligned with the conveyor access opening. Thereafter, the code wheel 60 is withdrawn through the slot 100 and out the access opening in the conveyor. At this time, the hourly character may be replaced with the current hourly character or any other required changes may also be effected by removal of old type and insertion of the appropriate current type. Preferably, however, at least two code wheels will be provided. During the preceeding production period, the replacement code wheel will be established with the current code for the next production sequence. Thus, after removal of one code wheel, the second code wheel is assembled to the sleeve in such a way that production down time is further minimized. The installation of the code wheel takes place in reverse order of the aforementioned removal. Therein, the U-shaped slot is roughly visually aligned with the sleeve, the collar 72 retracted and the code wheel 60 moved toward the sleeve 66 with the walls 104 of the slot 100 guiding the radial motion of the code wheel 60 until the base 102 of the slot engages the surface of the sleeve. At this time, the code wheel 60 is coaxially positioned with the shaft. The operator then rotates the code wheel until the operator feels that the tips of the drive pins 94 are aligned with the flange holes 95 The code wheel 60 is then shifted axially to fully insert the drive pins and the collar 72 is released to fully lock the code wheel 30. Thus, mounting and removal proceeds by guided self alignment, without requiring removal of fasteners, and with limited dexterous movements by the operator.

While the product coding assembly has been described with reference to debossing the end flap of a food carton, it should be apparent solid article or containers may be printed or embossed by the present assembly with product code as they travel along a conveyor path. Similarly, plural type arrays or rows of type may be incorporated for greater information and productivity. These and other modifications are contemplated by the present invention as set forth in the appended claims.

Having thus described my invention, I claim:

1. A coding wheel assembly for imprinting a legend on a package traveling along the path of a conveyor line having a shaft rotatable in synchronization with the path, said code wheel assembly comprising:

a mounting sleeve telescopically received over the shaft, said sleeve having a cylindrical outer surface rotatable coaxially with the shaft and a radially outwardly extending flange; a cylindrical code wheel having a generally U-shaped radially opening slot formed axially therethrough, said slot being defined by a semi-cylindrical base wall and side walls contiguous therewith, said slot being dimensioned such that said base wall coaxially engages said outer surface of said sleeve and the spacing of said side wall permits relative radial movement of said sleeve through said slot; an axially projecting pin carried on one of said code wheel or said flange which is axially slidably received in a hole formed in the other of said code wheel or said flange for fixedly radially and circumferentially locating said code wheel with respect to said sleeve in driving relationship therewith; a cylindrical collar slidably supported on said sleeve and having an annular surface engaging the radial surface of said code wheel; spring means for biasing said collar against said code wheel to maintain said driving relationship; said collar being axially shiftable against the biasing of said spring means to permit disengagement of said pin from said hole by axial sliding movement of said code wheel and removal of said code wheel through said slot; a plurality of circumferentially spaced slot means formed in the outer surface of said code wheel; a plurality of type means carried in said slot means having characters thereon reversely corresponding to the legend for the package; and a plurality of detent means on said code wheel separately releasably engaging each of said type means for retaining said type means in said slot means.

2. The code wheel assembly as recited in claim 1 wherein said indexing means includes a pair of pins carried by said code wheel adjacent said side walls of said slot which are slidably received in complementary holes formed in said flange of said sleeve.

3. The code wheel assembly as recited in claim 1 wherein each of said type means is retained by an independent detent member having a spring biased tip which compressively engages a recessed surface on said type means.

4. The code wheel assembly as recited in claim 3 wherein said detent members are carried alternately on opposite side of said code wheel.

5. The code wheel assembly as recited in claim 1 wherein a stop member is connected to said sleeve remote from said code wheel and said flange, said spring means is a helically coiled compression spring slidably carried by said sleeve having said one end engaging said stop member, and said collar has an outer cylindrical portion partially overlying said compression spring and frontally terminating with an inwardly turned annular flange which is compressively engaged by said other end of said compression spring.

6. The code wheel assembly as recited in claim 1 including roller means adapted to be carried by the conveyor line and means for biasing said roller means toward said outer surface of said code wheel for imparting a printing pressure between said type means and the packages as the latter travels along the path of the conveyor line between said code wheel and said roller means thereby imprinting the legend on the package upon rotation of the code wheel thereover.

7. The code wheel assembly as recited in claim 6 wherein said roller means has a resilient outer surface.

8. The code wheel assembly recited in claim 6 wherein said roller means includes a first bracket member adapted to be connected to the conveyor line and a second bracket member pivotally connected to the conveyor line, said second bracket member rotatably supporting said roller means and said means for biasing including compression spring acting between said first bracket member and said second bracket member.

9. The code wheel assembly recited in claim 8 wherein said code wheel comprises first and second axially abutting members, and wherein said slot in said code wheel has first and second portions, one in each of said members with one of said portions having a clearance with respect to said outer surface of said sleeve such that coaxial alignment on said sleeve is effected by the other of said abutting members.

10. The code wheel assembly recited in claim 9 wherein the other of said abutting members has a knurled outer cylindrical surface.

11. The code wheel assembly recited in claim 9 wherein said slot means include radially opening grooves of rectangular cross-section formed in one of said abutting members, and said type means have side walls slidably engaging the surfaces of said grooves.

12. The code wheel assembly recited in claim 11 wherein said type means project radially outward of said code wheel and have a peripheral operating speed substantially the same as the path of the conveyor line.

* * * * *